US006712632B2

(12) United States Patent
Wu

(10) Patent No.: US 6,712,632 B2
(45) Date of Patent: Mar. 30, 2004

(54) ELECTRICAL CONNECTOR HAVING LATCHES FOR REDUCING WARPAGE THEREOF

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/162,858

(22) Filed: Jun. 4, 2002

(65) Prior Publication Data

US 2003/0224646 A1 Dec. 4, 2003

(51) Int. Cl.[7] ..... H01R 13/62
(52) U.S. Cl. ..... 439/328; 439/79
(58) Field of Search ..... 439/328, 29–84, 439/374, 357, 325, 327, 358

(56) References Cited

U.S. PATENT DOCUMENTS 5,238,413 A * 8/1993 McCaffrey et al. ..... 439/79
5,660,557 A * 8/1997 Lemke et al. ..... 439/328
5,971,775 A * 10/1999 Tor et al. ..... 439/79
5,980,273 A * 11/1999 Yong et al. ..... 439/79
6,036,507 A * 3/2000 Knighton et al. ..... 439/79
6,045,386 A * 4/2000 Boe ..... 439/327
6,162,091 A * 12/2000 Kurotori et al. ..... 439/567
6,341,988 B1 * 1/2002 Zhu et al. ..... 439/630

OTHER PUBLICATIONS

Introducing Serial ATA White Paper.

* cited by examiner

*Primary Examiner*—Hien Vu
(74) *Attorney, Agent, or Firm*—Wei Te Chung

(57) ABSTRACT

An electrical connector (3) includes an elongated insulative housing (30), a number of terminals (311, 321, 331) received in the insulative housing. The insulative housing includes a front mating surface (301) adapted for mating with a complementary connector, an opposite terminating surface (302) and a pair of staggered latches (304) at a middle portion of the terminating surface of the housing. The latches extend rearwardly from the terminating surface and each has a hook (305) at a free end thereof for engaging with a printed circuit board (2).

7 Claims, 3 Drawing Sheets

ELECTRICAL CONNECTOR HAVING LATCHES FOR REDUCING WARPAGE THEREOF

BACKGROUND OF THE INVENTION

1. Field of the Invention

The present invention relates to an electrical connector, and particularly to an electrical connector having means for reducing warpage thereof.

2. Description of Prior Art

It is known that in some situation, an electrical connector is requested to connect a printed circuit board (PCB) and a plurality of complementary plug connectors. A conventional electrical connector of this type is disclosed in U.S. Pat. Nos. 5,549,480, 5,584,709, 5,238,413, 5,281,165 or 5,584,709. Such an electrical connector includes an insulative housing, such as an insert molding plastic housing, and a plurality of terminals received in the insulative housing. The insulative housing includes a front mating surface with the terminals extending therefrom, and a rear terminating surface, from which tails of the terminals are extended for being soldered to solder pads of the PCB.

In addition, an article, entitled "Introducing Serial ATA White Paper" announced by Serial ATA group on Nov. 7, 2000 at the website, http://www.maxtor.com/Quantum/src/whitepapers/$wp_{13}$ serialata.htm, indicated that as a next generation personal computer (PC) storage interface, Serial ATA will replace the Ultra ATA/100 interface used to connect most PCs to their primary storage, which is projected to become a bottleneck within two years. This article introduces the Serial ATA interface together with comparison to alternative storage interface and a standard of a Serial Advanced Technology Attachment ATA connector, which is not described in detail afterward. As widely used in PC, Serial ATA connector is possible to be used together with other kinds of connectors and combined with other connector sections into an X-in-one connector.

Some electrical connectors described above are designed or mounted at an edge of the printed circuit board. The insulative housing includes a plurality of opposite mounting ears extending beyond the rear terminating surface for positioning the connector on the PCB.

However, problems arise in designing above X-in-one connectors with a Serial ATA connector section. These problems often are associated with manufacturing the insulative housing or assembling the electrical connector on the PCB. For instance, the insulative housing, which is formed by plastic molding and relatively is long and thin, often has a problem of warpage about its middle portion so as to become vaulted or curvilinear. In addition, during assembling the connector on the PCB by soldering the terminals of the connector on the PCB, the heat produced thereby bring the thinner portion of the insulative housing into warpage. Therefore, the terminals of the electrical connector will improperly engage with solder pads of the PCB while assembling the electrical connector on the PCB.

Hence, an improved electrical connector is required to overcome the disadvantages of the conventional connector.

SUMMARY OF THE INVENTION

Accordingly, a first object of the present invention is to provide an improved electrical connector having means for solving warpage issue of a housing thereof.

A second object of the present invention is to provide an improved electrical connector whose terminals can be precisely soldered to a PCB by surface mounting technology (SMT).

A third object of the present invention is to provide an electrical connector which can by securely mounted to an edge of a PCB.

In order to achieve the objects above mentioned, an electrical connector assembled on a printed circuit board (PCB) comprises an elongated insulative housing, a plurality of terminals received in the insulative housing and four pairs of mounting ears formed by the insulative housing for clamping the PCB. The terminals are divided into three groups for achieving different functions. The insulative housing comprises a front mating surface adapted for mating with a complementary connector, an opposite terminating surface and a pair of staggered latches at a middle portion of the terminating surface of the housing. The latches extend rearwardly from the terminating surface and each has a hook at a free end thereof for engaging with the PCB.

Other objects, advantages and novel features of the invention will become more apparent from the following detailed description when taken in conjunction with the accompanying drawings.

DETAILED DESCRIPTION OF THE INVENTION

Figure 1:
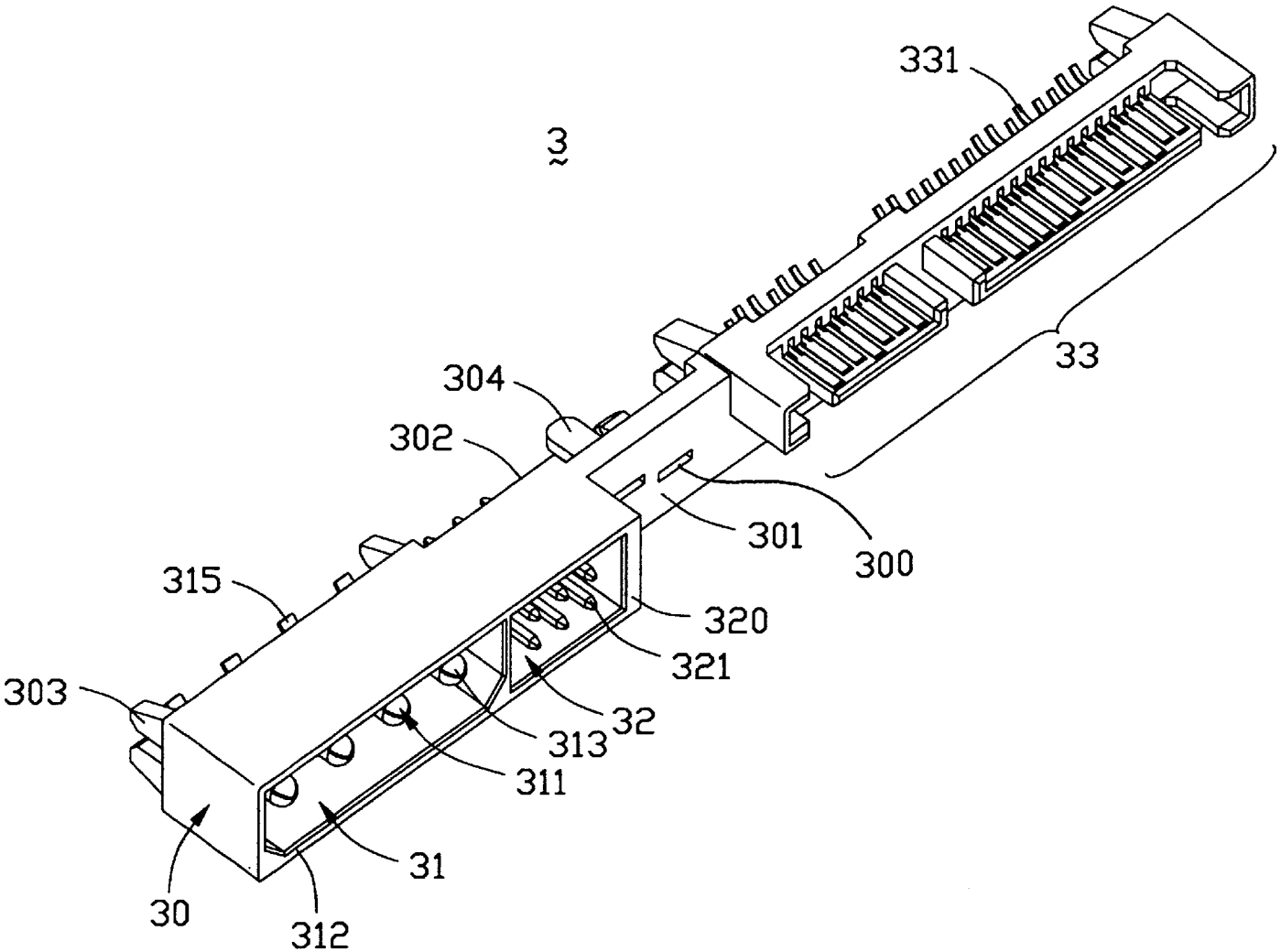
FIG. 1 is a front, perspective view of an electrical connector in accordance with the present invention.

Reference will now be made to the drawing figures to describe the present invention in detail.

Figure 2:
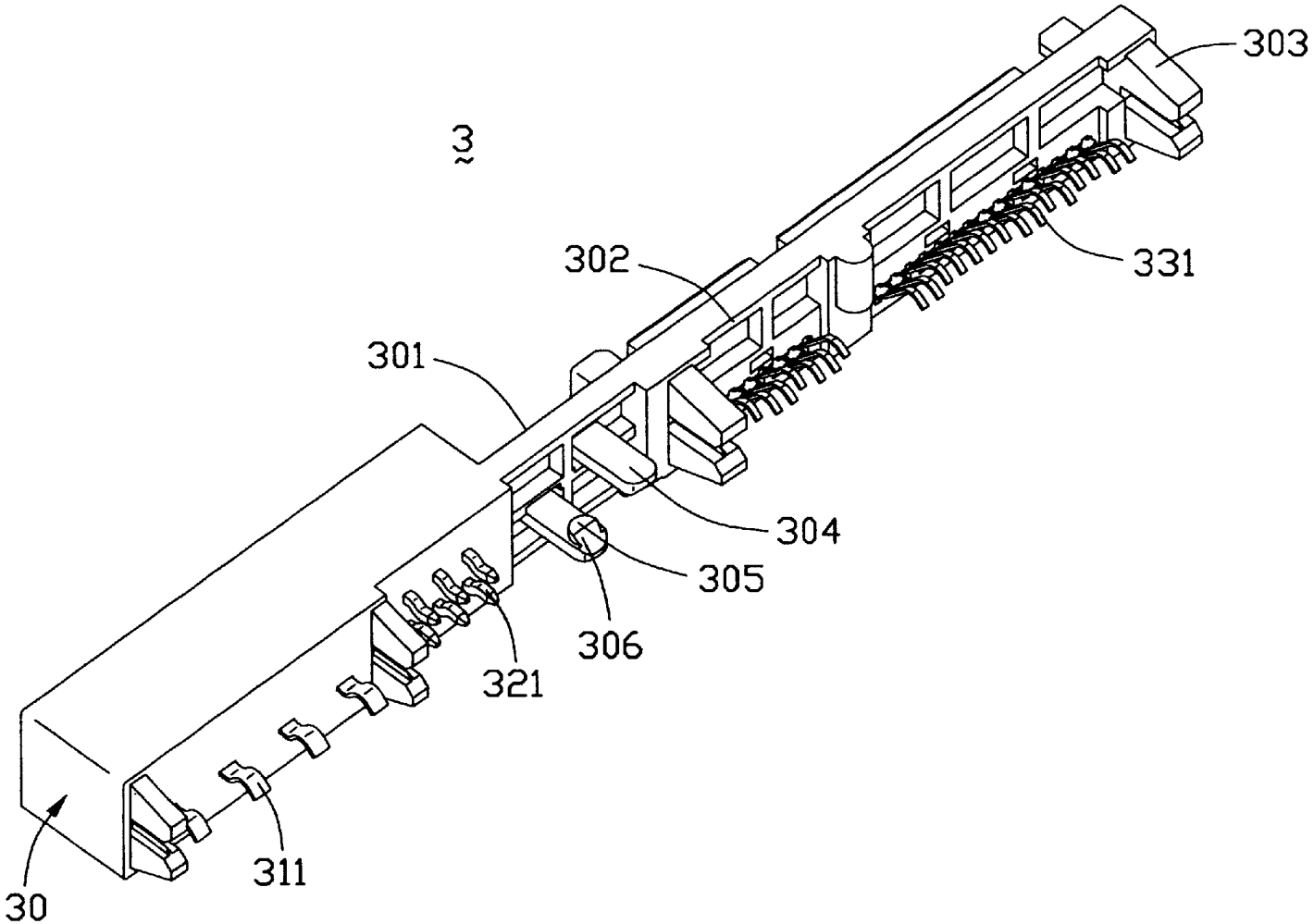
FIG. 2 is a rear, perspective view of the electrical connector shown in FIG. 1.
Figure 3:
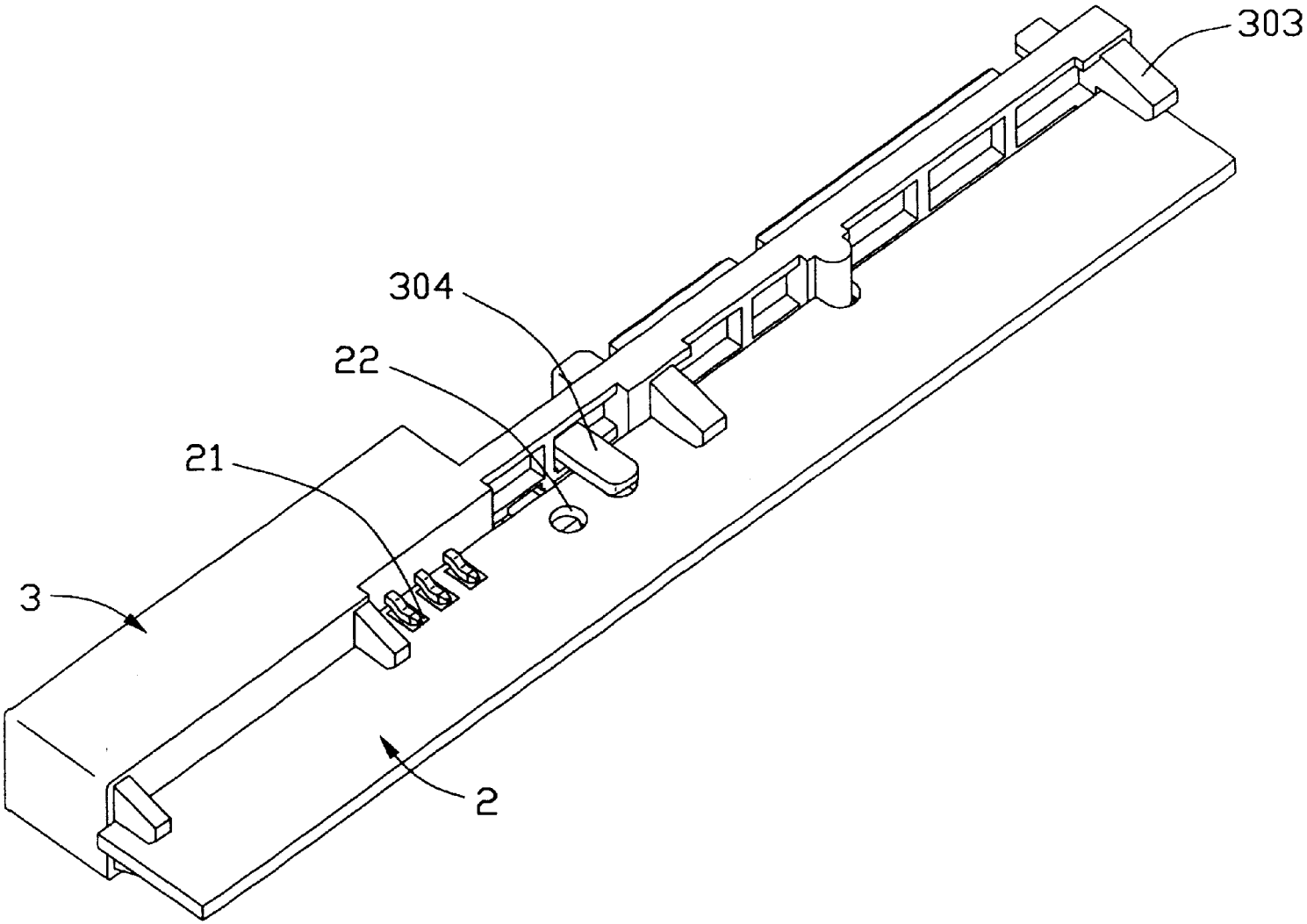
FIG. 3 is a rear, perspective view of the electrical connector mounted to an edge of a printed circuit board.

Referring to FIGS. 1–3, an electrical connector 3 of the present invention comprises an elongated insulative housing 30 with a front mating surface 301 and an opposite terminating surface 302. The insulative housing 30 includes three housing sections 31, 32 and 33 integrally arranged along a length thereof. The three sections 31, 32 and 33 are correspondingly termed power section 31, jumper section 32 and data section 33.

A plurality of power terminals 311 are accommodated in the power section 31 with front ends 313 thereof disposed at the mating surface 301. Rear ends 315 of the power terminals 311 extend beyond the terminating surface 302 for soldering to corresponding solder pads 21 on a PCB 2 in a straddle manner. A shroud 312, which is for med integrally with the insulative housing 30, envelops the front ends 313 of the power terminals 311 of the power section 31 to protect the power terminals 311. The jumper section 32 comprises a shroud 320 and a plurality of pins 321 enclosed by the shroud 320. Ends of the pins 321 extending from the mating surface 301 are arranged in an upper row and a lower row. Each pin 321 in the upper row is aligned with a corresponding one in the lower row. The other ends of the pins 321 extend rearwardly from the terminating surface 302 for soldering to the corresponding solder pads 21 of the PCB 2. In the present embodiment, the data section 33 is a serial ATA plug connector and includes a plurality of signal and power terminals 331.

The insulative housing 30 further comprises four pairs of opposite mounting ears 303 extending rearwardly from the terminating surface 302 and a pair of lengthwise staggered latches 304 extending rearwardly from upper and lower parts of a middle portion of the terminating surface 302. The latches 304 point toward each other and each of the latches 304 comprises a hook 305 extending from a free end thereof. Each hook 305 defines an inclined guiding face 306 for facilitating attaching the PCB 2 to the rear terminating surface 302 of the insulative housing 30. The middle portion of the housing 30 is the thinnest portion of the housing 30. The housing defines a through aperture 300 in a front-to-back direction aligned with each of the hook 305 for fully exposing the hook 305 to an exterior in a back-to-front direction so as not to use the expensive slide mold during molding for forming the hook 305.

In manufacturing the elongate insulative housing 30 by insert molding the insulative housing 30 with the terminals 311, 331 and the pins 321, the latches 304 in the middle of the insulative housing 30 may reducing a possible warpage of the housing 30 about the middle portion thereof. In addition, when the electrical connector 3 is mounted to an edge of the PCB 2, an end face of the PCB abuts against the terminating surface 302 of the housing 30, the mounting ears 303 clamp the edge of the PCB 2 and the hooks 305 are received in corresponding holes 22 of the PCB 2. Thus, even if the elongate housing 30 produces a little warpage, the engagement between the hooks 304 and the holes 22 may correct the warpage and ensures an exact connection between solder pads 21 of the PCB 2 and the terminals 311, 331 and the pins 321 of the electrical connector 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical device, comprising:

an electrical connector having an elongated insulative housing and a plurality of terminals received in the insulative housing, the insulative housing comprising a front mating surface adapted to mate with a complementary connector, an opposite rear terminating surface and a pair of latches at a middle portion of the housing, the latches integrally formed and extending rearwardly from the terminating surface, each of the latches having a hook at a free end thereof; and a printed circuit board (PCB) attached to the rear terminating surface of the insulative housing, the PCB having a plurality of solder pads thereon electrically connecting to corresponding terminals of the electrical connector, the PCB defining two voids receiving the hooks of the latches to secure the PCB to the rear terminating surface of the insulative housing; wherein the middle portion of the housing is the thinnest portion of the housing; wherein the latches are arranged in stagger along a longwise direction of the housing; wherein the housing of the connector further comprises at least a pair of mounting ears clamping the PCB.

2. The electrical device as described in claim 1, wherein each of the hooks have an inclined guiding surface for facilitating attaching the PCB to the rear terminating surface of the insulative housing.

3. The electrical device as described in claim 1, wherein the electrical connector comprises three connector portions for different functions.

4. The electrical device as described in claim 3, wherein one of the connector portions is a serial Advanced Technology Attachment (ATA) connector portion.

5. The electrical device as described in claim 1, wherein the voids are holes through the PCB.

6. An electrical connector assembly comprising:

an electrical connector including:

a one-piece insulative housing;

at least one pair of clamping mounting ears integrally formed and extending rearwardly from a rear face of the housing and defining a board receiving space therebetween;

a printed circuit board assembled to a rear portion of the housing with a front portion thereof located in said space and sandwiched between said pair of clamping mounting ears;

a plurality of terminals disposed in the housing, said terminals defining tails surface mounted on the front portion of the printed circuit board; and at least one resilient latch integrally formed and extending rearwardly from a middle of the rear face of the housing and substantially located on one side of said printed circuit board in a direction perpendicular to said printed circuit board; wherein said latch forms a hook extending in said direction and received in a hole in said front portion of said printed circuit board; wherein said hook defines a rearward chamfer so as to allow the front edge of the printed circuit board to abut against and further deflect outwardly the latch during assembling until the hook is received in the hole.

7. The assembly as described in claim 6, wherein said housing defines a through aperture in a front-to-back direction aligned with the hook for easing molding.

* * * * *